US011060314B2

(12) United States Patent
Suyama et al.

(10) Patent No.: US 11,060,314 B2
(45) Date of Patent: Jul. 13, 2021

(54) SUPPORT POST

(71) Applicant: TOYOTA JIDOSHA KABUSHIKI KAISHA, Toyota (JP)

(72) Inventors: Kazuo Suyama, Mitaka (JP); Hiroshi Nagai, Toyota (JP); Shinpei Murakami, Tokyo (JP); Kazuya Suenaga, Tsukuba (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/808,951

(22) Filed: Mar. 4, 2020

(65) Prior Publication Data

US 2020/0308863 A1 Oct. 1, 2020

(30) Foreign Application Priority Data

Mar. 28, 2019 (JP) ..... JP2019-064896

(51) Int. Cl.
*E04H 12/10* (2006.01)
*E04H 12/00* (2006.01)

(52) U.S. Cl.
CPC ..... *E04H 12/10* (2013.01); *E04H 12/003* (2013.01)

(58) Field of Classification Search
CPC ..... A01G 23/003; B66C 21/02; E01B 25/16; E01B 25/18; E04H 12/00; E04H 12/003; E04H 12/10; E04H 12/20
See application file for complete search history.

(56) References Cited

U.S. PATENT DOCUMENTS 1,358,203 A * 11/1920 Herrmann ..... B65D 7/12 220/691
1,438,119 A * 12/1922 Knapp ..... B65D 9/32 217/89
1,493,933 A * 5/1924 Gibbons ..... B65D 7/24 220/4.11
1,600,032 A * 9/1926 Barrick ..... E04H 12/08 52/295
2,069,531 A * 2/1937 Lehner ..... B65D 9/04 217/88
2,601,228 A * 6/1952 Shields ..... B66C 21/00 212/99
2,954,559 A * 9/1960 Yurek ..... H01Q 9/40 343/875
3,079,008 A * 2/1963 Naud ..... B66C 21/00 212/94
3,336,878 A * 8/1967 Malakhoff ..... B66C 21/00 104/114
3,439,107 A * 4/1969 Scott ..... E04H 12/10 174/45 R
3,709,754 A * 1/1973 Medler ..... B29C 70/56 156/161
3,863,774 A * 2/1975 Brandt ..... B66C 21/00 212/94
4,166,347 A * 9/1979 Pohlman ..... E04H 12/16 52/223.4

(Continued)

FOREIGN PATENT DOCUMENTS

JP H01-244807 A 9/1989

*Primary Examiner* — James M Ference
(74) *Attorney, Agent, or Firm* — Oliff PLC

(57) ABSTRACT

A support post includes a plurality of rod-like bodies, an annular member that bundles the rod-like bodies, and a base that supports and erects the rod-like bodies bundled by the annular member.

6 Claims, 3 Drawing Sheets

(56) References Cited

U.S. PATENT DOCUMENTS 4,196,551 A * 4/1980 Bondarenko ..... E04H 5/12 52/223.3
4,334,391 A * 6/1982 Hedgepeth ..... E04H 12/18 52/108
4,515,281 A * 5/1985 Maki ..... A01G 23/003 212/122
4,599,832 A * 7/1986 Benton ..... E04H 12/185 5/99.1
4,612,750 A * 9/1986 Maistre ..... B64G 9/00 52/638
4,646,924 A * 3/1987 Dayson ..... B61B 7/02 212/122
4,662,130 A * 5/1987 Miura ..... E04H 12/185 52/108
4,677,803 A * 7/1987 Mikulas, Jr. ..... E04H 12/18 182/152
4,687,109 A * 8/1987 Davis ..... B66C 21/00 212/76
4,918,884 A * 4/1990 Okazaki ..... B64G 9/00 52/108
4,958,474 A * 9/1990 Adams ..... B64G 9/00 52/108
5,513,477 A * 5/1996 Farber ..... E04H 12/02 52/834
5,832,688 A * 11/1998 Crissey ..... E04H 12/10 52/651.01
7,059,096 B2 * 6/2006 Kuebler ..... E04H 12/003 174/45 R
8,434,274 B2 * 5/2013 Anderson, Jr. ..... A01M 29/32 52/101
8,973,309 B2 * 3/2015 Amir ..... E04H 12/10 52/80.2
10,513,866 B2 * 12/2019 Brandao ..... E02D 27/50
2004/0139665 A1 * 7/2004 Ullrich ..... E04H 12/16 52/169.9
2005/0126106 A1 * 6/2005 Murphy ..... B64G 1/222 52/652.1
2009/0071920 A1 * 3/2009 Bassetti ..... A47B 73/006 211/74
2014/0041314 A1 * 2/2014 Amir ..... E04H 12/10 52/8
2015/0218840 A1 * 8/2015 Paton ..... E04H 12/10 52/651.01
2017/0244234 A1 * 8/2017 Behr ..... H02G 13/80
2018/0111722 A1 * 4/2018 Deutsch ..... B65D 45/02
2018/0371783 A1 * 12/2018 Reyes ..... E04H 12/085
2019/0338548 A1 * 11/2019 Brandao ..... E04H 12/20
2020/0308863 A1 * 10/2020 Suyama ..... B66C 21/02

* cited by examiner

SUPPORT POST

INCORPORATION BY REFERENCE

The disclosure of Japanese Patent Application No. 2019-064896 filed on Mar. 28, 2419 including the specification, drawings and abstract is incorporated herein by reference in its entirety.

BACKGROUND

1. Technical Field

The disclosure relates to an assembling type support post.

2. Description of Related Art

A tubular steel post constructed by placing a plurality of vertical reinforcement members in an outer shell, and then pouring concrete into the outer shell, is disclosed in Japanese Unexamined Patent Application Publication No. 1-244807 (JP 1-244807 A). To construct the steel post, a horizontal reinforcement member having a helical shape is engaged with hooks projecting from an inner surface of the outer shell, and the vertical reinforcement members are arranged in parallel, along the inner side of the lateral reinforcement member.

SUMMARY

In a cable yarding system that conveys timber cut in a forest, relatively large support posts are erected in the forest. Operation to erect the support posts in the forest is not easy.

The disclosure provides a support post that can be easily erected.

A support post according to one aspect of the disclosure includes a plurality of rod-like bodies, an annular member that bundles the rod-like bodies, and a base that supports and erects the rod-like bodies bundled by the annular member.

According to the disclosure, the support post can be easily erected.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
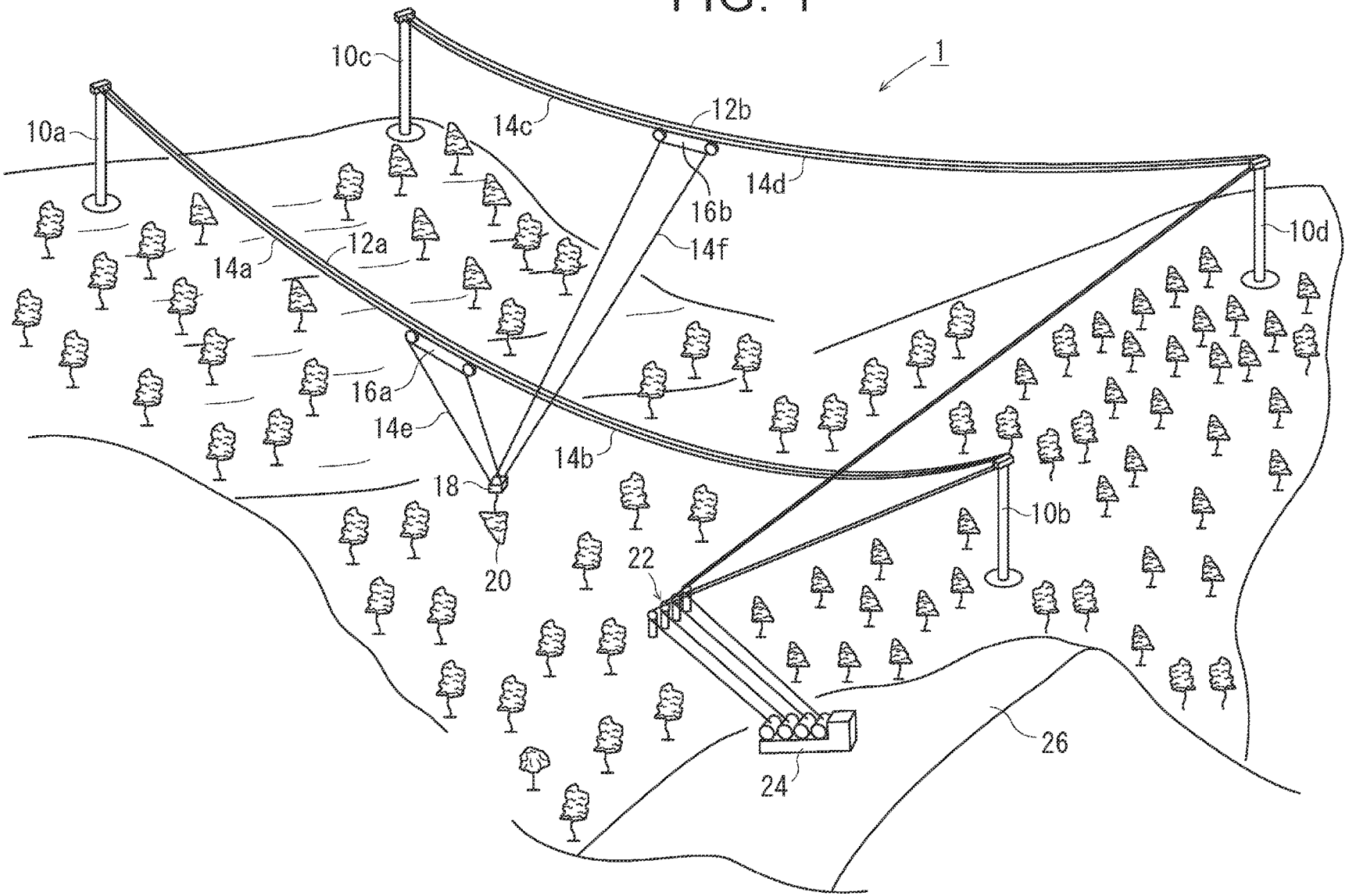
FIG. 1 is a view useful for describing a cable yarding system.

FIG. 1 is a view useful for describing a cable yarding system 1. The cable yarding system 1 includes a first support post 10*a*, second support post 10*b*, third support post 10*c*, fourth support post 10*d* (each of which will be called "support post 10" when they are not distinguished from one another), first main cable 12*a*, second main cable 12*b* (each of which will be called "main cable 12" when they are not distinguished from each other), first operation cable 14*a*, second operation cable 14*b*, third operation cable 14*c*, fourth operation cable 14*d*, fifth operation cable 14*e*, sixth operation cable 14*f* (each of which will be called "operation cable

14" when they are not distinguished from one another), first moving device 16*a*, second moving device 16*b* (each of which will be called "moving device 16" when they are not distinguished from each other), holding device 18, guide pulleys 22, and yarder 24.

The cable yarding system 1 is a so-called H-shaped cable yarding system, and is used for lifting a tree 20 felled in a forest, with the main cables 12 and operation cables 14 hung in the air, and conveying the tree 20 to a collection place 26 or its vicinity. In this manner, it is possible to convey trees 20 from the forest, without constructing roads.

The four support posts 10 are erected at positions that are suitable for installation and determined based on the arrangement of standing trees and the position of the collection place 26. The size of each support post 10 is set to about 5 meters to 10 meters, depending on the size of the cable yarding system 1, for example.

The main cables 12 and operation cables 14 are fixed as cables to the support posts 10, or are wrapped around pulleys of the support posts 10. The first main cable 12*a* is fixed to the first support post 10*a* and the second support post 10*b*, and the second main cable 12*b* is fixed to the third support post 10*c* and the fourth support post 10*d*. The first main cable 12*a* and second main cable 12*b*, which function as rails in the air, are installed so as not to intersect with each other. The length of each main cable 12 is about 300 meters to 1500 meters.

The operation cables 14 function as moving cables that are wound by the moving devices 16 or yarder 24. The first operation cable 14*a*, second operation cable 14*b*, third operation cable 14*c*, and fourth operation cable 14*d* are wrapped around the pulleys provided on the support posts 10, and one end of each operation cable 14 is connected to the corresponding moving device 16, while the other end is connected to the yarder 24. The first operation cable 14*a* is connected from the yarder 24 to the first moving device 16*a* via the second support post 10*b* and the first support post 10*a*. The second operation cable 14*b* is connected from the yarder 24 to the first moving device 16*a* via the second support post 10*b*. The third operation cable 14*c* is connected from the yarder 24 to the second moving device 16*b* via the fourth support post 10*d* and the third support post 10*c*. The fourth operation cable 14*d* is connected from the yarder 24 to the second moving device 16*b* via the fourth support post 10*d*. The fifth operation cable 14*e* and sixth operation cable 14*f* are connected to the moving devices 16 and the holding device 18.

The first moving device 16*a* and second moving device 16*b* are supported by the first main cable 12*a* and second main cable 12*b*, respectively, and are movable along the first main cable 12*a* and second main cable 12*b*. The first operation cable 14*a*, second operation cable 14*b*, and fifth operation cable 14*e* are connected to the first moving device 16*a*, and the third operation cable 14*c*, fourth operation cable 14*d*, and sixth operation cable 14*f* are connected to the second moving device 16*b*. The fifth operation cable 14*e* connects the first moving device 16*a* with the holding device 18, and the sixth operation cable 14*f* connects the second moving device 16*b* with the holding device 18. The moving devices 16 function to wind the fifth operation cable 14*e* and the sixth operation cable 14*f*, according to command signals wirelessly transmitted thereto.

The holding device 18 has a hook that grabs the tree 20. A wire may further extend from the holding device 18, and the holding device 18 is able to wind the wire. Thus, the hook of the holding device 18 can be moved up and down.

The guide pulleys 22 change the directions of the operation cables 14 wrapped around the pulleys 22. The yarder 24 functions as winches to wind the operation cables 14, respectively, and has drums and drive sources for winding or unwinding the respective operation cables 14.

Operation of the cable yarding system 1 will be described. The yarder 24 winds one of the first operation cable 14*a* and the second operation cable 14*b* and unwinds the other, so as to move the first moving device 16*a* along the first main cable 12*a*. Also, the yarder 24 winds one of the third operation cable 14*c* and the fourth operation cable 14*d* and unwinds the other, so as to move the second moving device 16*b* along the second main cable 12*b*. As a result, the holding device 18 is displaced along the main cables 12.

When the moving devices 16 wind one of the fifth operation cable 14*e* and the sixth operation cable 14*f* and unwind the other, the holding device 18 moves between the first moving device 16*a* and the second moving device 16*b*. Thus, the holding device 18 moves in two-dimensional directions, within a region surrounded by the four support posts 10, so as to convey the tree 20 felled within the region.

In the meantime, the support post 10 is a large instrument that is required to be resistant to a load of several thousands of kilograms; therefore, it is not easy to carry the support post 10 to an installation point in a forest having no roads. Thus, the support post 10 of this embodiment is of an assembling type, and is adapted to be constructed by carrying components of the support post 10 to the installation point, and assembling the components together. Thus, if a simple cable is extended to the installation point, by use of an unmanned aircraft, for example, the components of the support post 10 can be easily conveyed to the installation point, by use of the cable.

Figure 2:
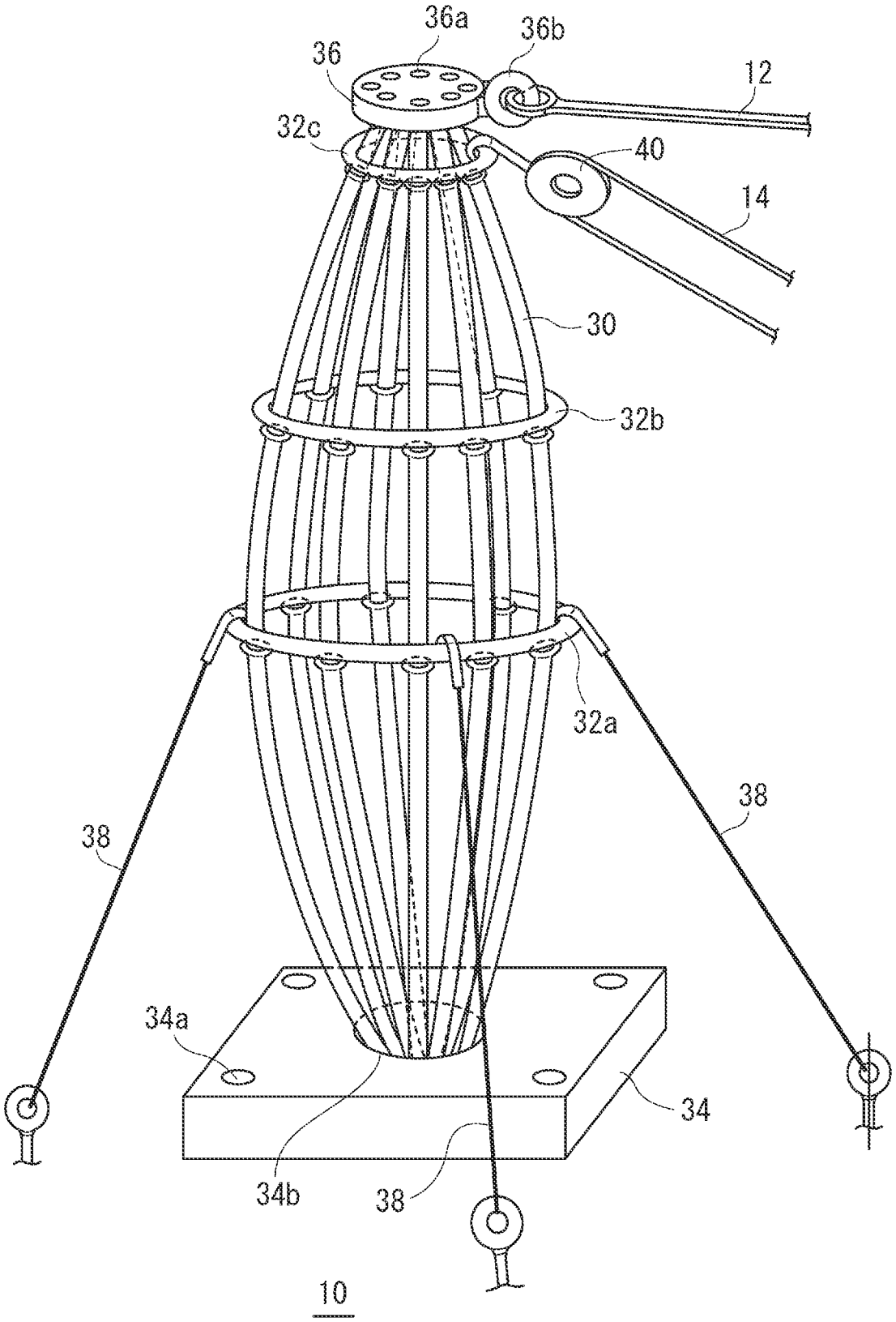
FIG. 2 is a perspective view of a support post of one embodiment.

FIG. 2 is a perspective view of the support post 10 of this embodiment. The support post 10 includes a plurality of rod-like bodies 30, first annular member 32*a*, second annular member 32*b*, third annular member 32*c* (each of which will be called "annular member 32" when they are not distinguished from one another), base 34, retainer 36, a plurality of supports 38, and pulley 40.

Figure 3:
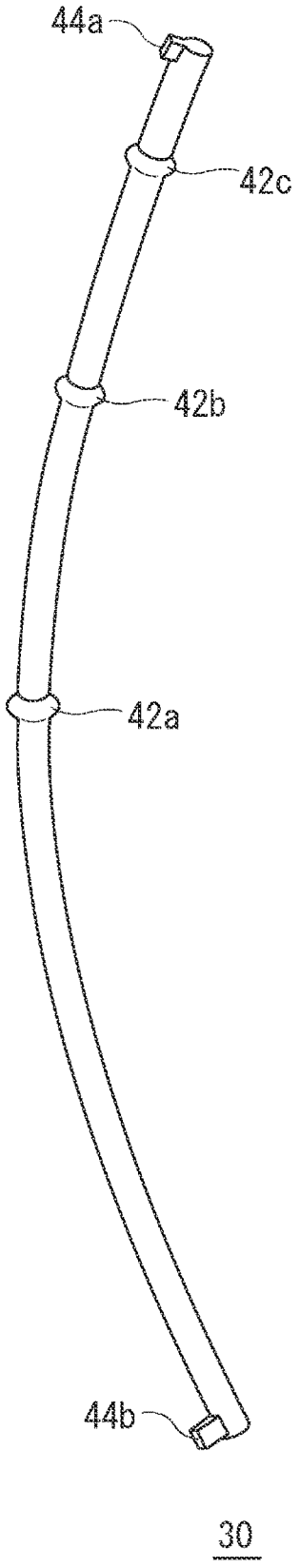
FIG. 3 is a perspective view of a rod-like body.

The rod-like bodies 30 are bundled together by the annular members 32, and are erected by means of the base 34 and the supports 38. Referring to FIG. 3, the rod-like body 30 will be described.

FIG. 3 is a perspective view of the rod-like body 30. The rod-like body 30 has a first flange portion 42*a*, second flange portion 42*b*, third flange portion 42*c* (each of which will be called "flange portion 42" when they are not distinguished from one another), first rotation inhibiting portion 44*a*, and second rotation inhibiting portion 44*b* (each of which will be called "rotation inhibiting portion 44" when they are not distinguished from each other).

The rod-like body 30 is formed of a fiber material, such as glass fiber, in the shape of a bow. With the rod-like body 30 thus formed of the fiber material, the weight of the support post 10 can be reduced to be about a half of that of a support post made of a metallic material. Also, since the rod-like body 30 is formed in the shape of a bow, the rod-like bodies 30, when assembled together, can be radially pressed against the annular members 32, to be less likely or unlikely to be disengaged from the annular members 32, and the support post 10, to which a load is continuously applied, can be stably erected. The degree of curving of the rod-like body 30 is not limited to that of the embodiment shown in FIG. 3, but may be set by experiment, or the like, to be different from that of FIG. 3.

The flange portions 42 having relatively large diameters are formed at some points on the rod-like body 30, such that they project radially outward. Thus, when the support post 10 is in an assembled state, the annular members 32 are engaged with the flange portions 42, so that downward movement of the annular members 32 is restricted.

The rotation inhibiting portions 44 are formed at opposite end portions of the rod-like body 30, to protrude radially outward. The first rotation inhibiting portion 44*a* is located on the upper part of the rod-like body 30, and the second rotation inhibiting portion 44*b* is located on the lower part of the rod-like body 30. When the support post 10 is in the assembled state, the rotation inhibiting portions 44 abut against the base 34 or retainer 36, so as to inhibit rotation of the rod-like bodies 30 about their axes. The flange portions 42 and rotation inhibiting portions 44 may be integral with the main body of the rod-like body 30, or may be separate parts from the main body.

Referring back to FIG. 2, the annular members 32 surround the rod-like bodies 30 and bundle them together. The first annular member 32*a* engages with the first flange portions 42*a*, and the second annular member 32*b* engages with the second flange portions 42*b*, while the third annular member 32*c* engages with the third flange portions 42*c*. The diameter of the first annular member 32*a* is larger than that of the second annular member 32*b*, and the diameter of the second annular member 32*b* is larger than that of the third annular member 32*c*. Each of the annular members 32 may be shaped like a ring having a given diameter, or may be formed into the shape of a ring by tightening a wire, or the like, and fixing its end portions with a fixture.

The rod-like bodies 30 are equally spaced apart from each other in the circumferential direction, and a central part of the support post 10 expands radially outward, to provide an elongated ellipsoidal structure. With this arrangement, when a load is applied to the upper part of the support post 10, each of the rod-like bodies 30 can press the annular members 32 in radial directions.

The base 34 supports the lower parts of the rod-like bodies 30 bundled together, so as to erect the rod-like bodies 30. The base 34 has a plurality of holes 34*a* for fixing the base 34 to the ground, and an insertion hole 34*b* into which the rod-like bodies 30 are inserted. The holes 34*a* for fixing are formed at four corners of the base 34, and the base 34 is fixed to the ground with pins driven into the holes 34*a*.

The insertion hole 34*b* has a plurality of grooves that engages with the second rotation inhibiting portions 44*b* of the rod-like bodies 30, so as to inhibit rotation of the rod-like bodies 30 about the axis. The insertion hole 34*b* may be individually formed for each of the rod-like bodies 30.

The retainer 36 is formed like a disk, and holds upper end portions of the rod-like bodies 30. The retainer 36 is formed with a plurality of rotation inhibiting holes 36*a* into which the upper end portions of the rod-like bodies 30 can be respectively inserted. The rotation inhibiting holes 36*a* have respective grooves that are formed in the axial direction and engage with the first rotation inhibiting portions 44*a* of the rod-like bodies 30. The base 34 and the retainer 36 cooperate with each other to hold the rod-like bodies 30, and inhibit rotation of the opposite end portions of the rod-like bodies 30, so as to make the posture of the support post 10 stable.

The supports 38 are installed such that one end of each support 38 is connected to the first annular member 32*a*, and the other end is driven into the ground. With the supports 38 thus provided, the first annular member 32*a* is inhibited from moving upward, and the first annular member 32*a* is less likely or unlikely to be disengaged upward. In the embodiment of FIG. 2, the first annular member 32*a* is provided with the supports 38. However, each of the second annular member 32*b* and the third annular member 32*c* may also be provided with the supports 38.

The retainer 36 is formed with a connecting portion 36*b* for connecting the main cable 12 with the support post 10. Also, a pulley 40 around which the operation cable 14 is wrapped is attached to the third annular member 32*c*. The pulley 40 may be attached to the retainer 36. Also, another member for supporting the main cable 12 and the operation cable 14 on the support post 10 may be provided at the upper part of the support post 10.

The disclosure has been described based on the embodiment. It is to be understood by those skilled in the art that the illustrated embodiment is merely exemplary, that the embodiment may have modified examples having various combinations of constituent elements and operation processes, and that these modified examples are also within the scope of the disclosure.

While the rod-like body 30 is formed of a fiber material, in the shape of a bow, in the illustrated embodiment, the disclosure is not limited to this arrangement. For example, the rod-like body 30 may be formed of a metallic material. Also, the rod-like body 30 may be formed in the shape of a straight line. In any case, the support post 10 is of an assembling type, and its components before assembling are easy to convey.

In the illustrated embodiment, the rod-like bodies 30 are arranged in an elongated ellipsoidal form. In addition to the arcuate rod-like bodies 30, a straight rod-like body may be provided on the center axis of the support post 10. An upper end portion of the rod-like body on the center axis and upper end portions of the arcuate rod-like bodies 30 are connected to each other, so that the support post 10 can be stabilized, and the load resistance can be improved.

While the support post 10 is used in the cable yarding system 1 in the illustrated embodiment, the disclosure is not limited to this application, but the support post may be used in another system that supports cables.

What is claimed is:

1. A support post comprising:

a plurality of cylindrical rod-shaped bodies, at least one of the rod-shaped bodies being curved in a shape of a bow, each of the plurality of rod-shaped bodies having (i) a first rotation inhibiting projection that protrudes radially outward from an upper part of a corresponding one of the plurality of rod-shaped bodies, and (ii) a second rotation inhibiting projection that protrudes radially outward from a lower part of the corresponding one of the plurality of rod-shaped bodies, and the plurality of rod-shaped bodies are arranged such that a central portion of the shape of the bow of the plurality of rod-shaped bodies expands radially outward;

an annular ring that bundles the plurality of rod-shaped bodies;

a base that supports and erects the plurality of rod-shaped bodies bundled by the annular ring, the base having a plurality of grooves that each engages with the second rotation inhibiting projection; and a retainer disk that holds the respective upper end portion of each of the plurality of rod-shaped bodies, the retainer disk having grooves that each engages with the first rotation inhibiting projection.

2. The support post according to claim 1, wherein:

the plurality of rod-shaped bodies each have at least one flange portion that projects radially outward from the respective rod-shaped body of the plurality of rod-shaped bodies; and the at least one flange portion is located under the annular ring, and the at least one flange portion is configured to restrict downward movement of the annular ring.

3. The support post according to claim 2, wherein:

each of the plurality of rod-shaped bodies has a plurality of the flange portions; and each of the plurality of rod-shaped bodies has a plurality of annular rings, and a number of the plurality of annular rings is a same number as a number of the plurality of flange portions.

4. The support post according to claim 1, further comprising a support connected to the annular member, the support being configured to restrict upward movement of the annular ring.

5. The support post according to claim 1, wherein the plurality of rod-shaped bodies are formed of a fiber material.

6. The support post according to claim 1, further comprising a pulley around which a cable is wrapped for yarding.

* * * * *